United States Patent [19]

Siegwart et al.

[11] 4,064,319

[45] Dec. 20, 1977

[54] UPSET HEAD AT A HIGH-STRENGTH TENSION WIRE AND METHOD FOR THE PRODUCTION THEREOF

[75] Inventors: Hans Rudolf Siegwart, Kilchberg; Dietmar Leeb, Zurich, both of Switzerland

[73] Assignee: Bureau BBR Ltd., Zurich, Switzerland

[21] Appl. No.: 651,292

[22] Filed: Jan. 22, 1976

[30] Foreign Application Priority Data

Feb. 7, 1975 Switzerland ..... 1504/75

[51] Int. Cl.[2] ..... B21C 37/04; B21F 5/00

[52] U.S. Cl. ..... 428/602; 85/28

[58] Field of Search ..... 85/28, 37; 52/223 R; 29/193; 10/27 R; 72/377, 318; 425/111; 428/602

[56] References Cited

U.S. PATENT DOCUMENTS

| | | | |
|---|---|---|---|
| 1,325,721 | 12/1919 | Hill | 85/28 X |
| 3,255,558 | 6/1966 | Middendorf | 52/223 R |
| 3,561,102 | 2/1971 | Diemer | 85/37 X |
| 3,828,382 | 8/1974 | Nakamura | 10/27 R |

*Primary Examiner*—Othell M. Simpson
*Assistant Examiner*—Horace M. Culver

[57] ABSTRACT

An upset head and a method of producing the same at a high-strength tension wire, wherein there is formed a supporting seating surface at the transition between the head and the wire. The maximum head diameter is located in the third of the height of the head situated closest to the seating surface. The head diameter at the free head end is equal to or smaller than the wire diameter and the head possesses the shape of a truncated cone at its end section.

3 Claims, 1 Drawing Figure

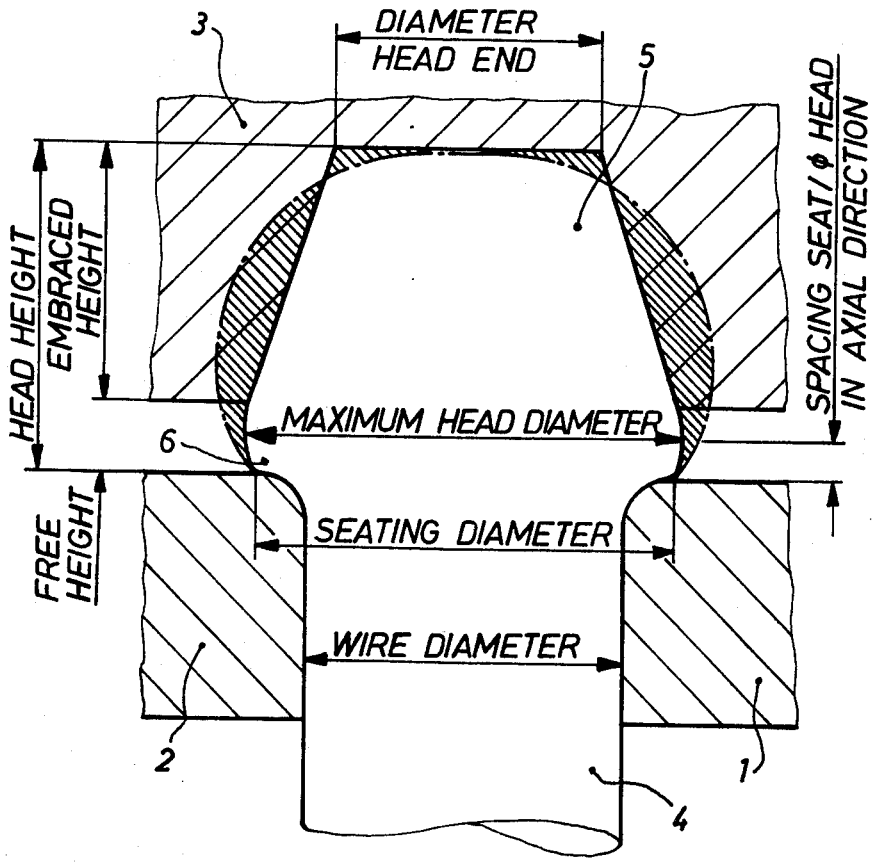
DIAMETER
HEAD END
3
5
HEAD HEIGHT
EMBRACED HEIGHT
SPACING SEAT/ϕ HEAD
IN AXIAL DIRECTION
MAXIMUM HEAD DIAMETER
6
FREE HEIGHT
SEATING DIAMETER
WIRE DIAMETER
2
1
4

UPSET HEAD AT A HIGH-STRENGTH TENSION WIRE AND METHOD FOR THE PRODUCTION THEREOF

BACKGROUND OF THE INVENTION

The present invention relates to a new and improved construction of upset head at a high-strength tension wire wherein at the transition between the head and the wire there is formed a seating surface for support purposes, and this invention further pertains to a new and improved method for the production of such head.

It is known for considerable time to provide tension or tensioning wires with upset heads, specifically cold upset heads. The tension wires are supported at one end by means of these heads at an anchoring body. Apart from the diameter of the wire there of course also is of considerable importance the seating surface between the head and the wire. With conventional upset heads, oftentimes possessing a spherical shape, the maximum head diameter, i.e., the largest head diameter is located at a relatively great distance from the seating surface, this being considered in relation to the height of the head. It has been found that this state-of-the-art position of the maximum head diameter in the case of cold upset heads has associated therewith relatively poor material deformation during the shaping operation, which in turn can lead to fissures, even if such are of a fine nature, at the surface and internally of the head. Furthermore, it is to be noted that the cold working or deformation of a material, apart from its metallurgical composition, in the first instance is dependent upon its strength characteristics and structure. In comparison with normal cold upset steels drawn tension wires for prestressed concrete structures possess more than twice as great strength, less contraction rupture and a different structure. The upsetting of anchoring heads therefore requires, both with regard to the shaping or forming thereof as well as also with respect to the actual upset technique, special measures.

SUMMARY OF THE INVENTION

Hence, it is a primary object of the present invention to provide an improved construction of upset head at a high-strength tension wire which does not possess the aforementioned drawbacks and shortcomings of the prior art constructions.

Still a further significant object of the present invention aims at a new and improved method of providing a novel upset head at a tension wire in an extremely efficient and reliable manner.

Now in order to implement these and still further objects of the invention, which will become more readily apparent as the description proceeds, the upset head at a high-tensile or high-strength tension wie as contemplated by the invention is manifested by the features that the largest or maximum head diameter is located within that third of the height of the head which is situated closest to the seating surface, preferably in the last quarter of the head height. Further, the head diameter at the free had end is smaller than the wire diameter and the head at its end section possesses the shape of a truncated cone.

By virtue of this particular construction of the upset head it has been found that the formation of fissures or ruptures at the head surface can be eliminated.

This optimum head shape furthermore enables accommodating the seating surface serving for support to the particular requirements, i.e., generally increasing the seating surface since the head shape of the invention can be realised with minimum deformation.

Moreover, during the upsetting work the wire is considerably better centered and guided, and at the same time there is realised a considerably improved external guiding by means of the upsetting tool, i.e., the height of the head surrounded by the tool is appreciably greater in comparison to previous methods.

A further aspect of the invention relates to a method for fabricating such upset head wherein the wire is fixedly held between clamping jaws at the neighbourhood of its end and the protruding end is shaped into a head by cold upsetting with the aid of a shaping tool. According to the method aspects of the invention there is employed a shaping tool having a truncated conical-shaped shaping recess, the wire being self-centered during tool movement, and the tool, with the exception of a free gap, corresponding approximately to one third of the height of the finished head, is moved towards the clamping or holding jaws in such a manner that there is formed the desired head with minimum material deformation internally of the head.

This manufacturing technique requires a minimum of material deformation during the upsetting operation and therefore minimum material deformation internally of the head, which otherwise could lead to structural defects. At the same time there is also obtained an optimum upsetting work as concerns the time required to accomplish the same, i.e., the upsetting operation is carried out while being optimumly controlled.

During the shaping by upsetting of anchoring heads generally care must be taken that there is realised a positive transmission of the tension force effective in the steel wire to the anchoring head. The tension force should be capable of being increased up to the effective tension rupture load of the wire. To render possible this force transmission the upset head must possess a sufficient seating surface at the contact zone to an anchor head. The size and shape of the required seating surface, for a given steel wire, depends upon the bore hole diameter and of course also the strength characteristics of the employed supporting material, i.e., the anchoring body.

With the inventive upset head and with the inventive upsetting method for forming such head there is achieved the beneficial result that during upsetting of the head there is realised the required seating diameter with minimum material deformation. This minimum or optimum deformation is then realised when with the largest possible seating diameter the diameter of the head can be maintained at a minimum.

With the heretofore known upset heads, which more or less possess a spherical configuration, the head diameter was always considerably more unfavorable with respect to the seating diameter.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE thereof illustrates an upset head at a tension wire which has been produced according to the present invention.

DETAILED DESCRIPTION OF THE PREFERRED EMBODIMENTS

Describing now the drawing, the invention will be disclosed in greater detail hereinafter on the basis of the drawing wherein there is compared in particular the novel and inventive shape of an upset head of this development with a conventional shape. From this drawing it will be also recognized that with the heretofore prior art upset heads it was necessary to shape or deform considerably more material in order to achieve a predetermined seating diameter and a predetermined seating surface. The spherical heads of course also have the drawback that they only can be engaged by the tool over a relatively small portion of the height of the head.

Continuing, it will be seen that the drawing illustrates a wire 4 with an upset head 5, wherein there has been illustrated the position of the holding or clamping jaws 1, 2 and the upsetting tool 3 at the end of the upsetting work. Further, it will be seen that with approximately the same height of the head (hereinafter referred to as head height) for a conventional head (shown in phantom lines) and with the same wire diameter, considerably more material must be deformed. The shaded regions indicate those locations where there has occurred a larger material deformation. This material deformation or shaping furthermore brings with it additional structural changes internally of the head which can be disadvantageous. It is also to be seen how by means of the conical recess in the upsetting tool 3 the actual wire 4 is centered and guided at the start of the upsetting work. Such centering previously was not possible. The drawing also indicates that the head diameter is only inconsequentially larger than the seating diameter, something which was possible by virtue of the favorable position of the maximum head diameter.

The maximum head diameter is located in the third of the head height located closest to the seating surface 6, and advantageously such maximum head diameter is located in the last quarter of the head height. Moreover, the ratio of the wire diameter to the head height advantageously may be in the order of 1.2 to 0.8.

While there is shown and described present preferred embodiments of the invention, it is to be distinctly understood that the invention is not limited thereto, but may be otherwise variously embodied and practiced within the scope of the following claims. Accordingly,

What is claimed is:

1. A tension wire, of high tensile strength steel provided with an upset head, said head comprising a free end and a supporting seating surface situated at a transition point between the upset head and the remaining part of the wire, said head having a maximum diameter which is located within the third of the height of the head situated closest to the supporting seating surface, the diameter of the head at the free end being at most equal to the wire diameter, and the ratio of the wire diameter to the head height being in the order of 1.2 to 0.8.

2. A wire and upset head as defined in claim 1, wherein the head diameter at said free end is smaller than the wire diameter.

3. A wire and upset head as defined in claim 1, wherein the maximum head diameter is located within a last quarter of the height of the head situated closest to the seating surface.

* * * * *